US005135640A

United States Patent [19]

Vizner

[11] Patent Number: 5,135,640

[45] Date of Patent: Aug. 4, 1992

[54] HIGH EFFICIENCY PROCESS FOR PREPARATION OF GASOLINE BY CATALYTIC CRACKING

[75] Inventor: Steven Vizner, Monroe, Conn.

[73] Assignee: Texaco Inc., White Plains, N.Y.

[21] Appl. No.: 608,667

[22] Filed: Nov. 5, 1990

[51] Int. Cl.[5] ..... C10G 37/00

[52] U.S. Cl. ..... 208/92; 208/80; 208/86; 208/87; 208/93

[58] Field of Search ..... 208/80, 92, 93, 86, 208/87

[56] References Cited

U.S. PATENT DOCUMENTS

| | | | |
|---|---|---|---|
| 3,637,483 | 1/1972 | Carey | 208/80 |
| 3,723,295 | 3/1973 | Kress | 208/93 |
| 3,968,023 | 7/1976 | Yan | 208/93 |
| 4,165,274 | 8/1979 | Kwant | 208/92 |

*Primary Examiner*—Helane Myers

*Attorney, Agent, or Firm*—Robert A. Kulason; James J. O'Loughlin; Carl G. Seutter

[57] ABSTRACT

Catalytic Cracking is effected by feeding thereto (i) a deasphalted vacuum resid together with (ii) a solvent treated virgin vacuum gas oil, the two being preferably mixed prior to solvent treating.

9 Claims, 1 Drawing Sheet

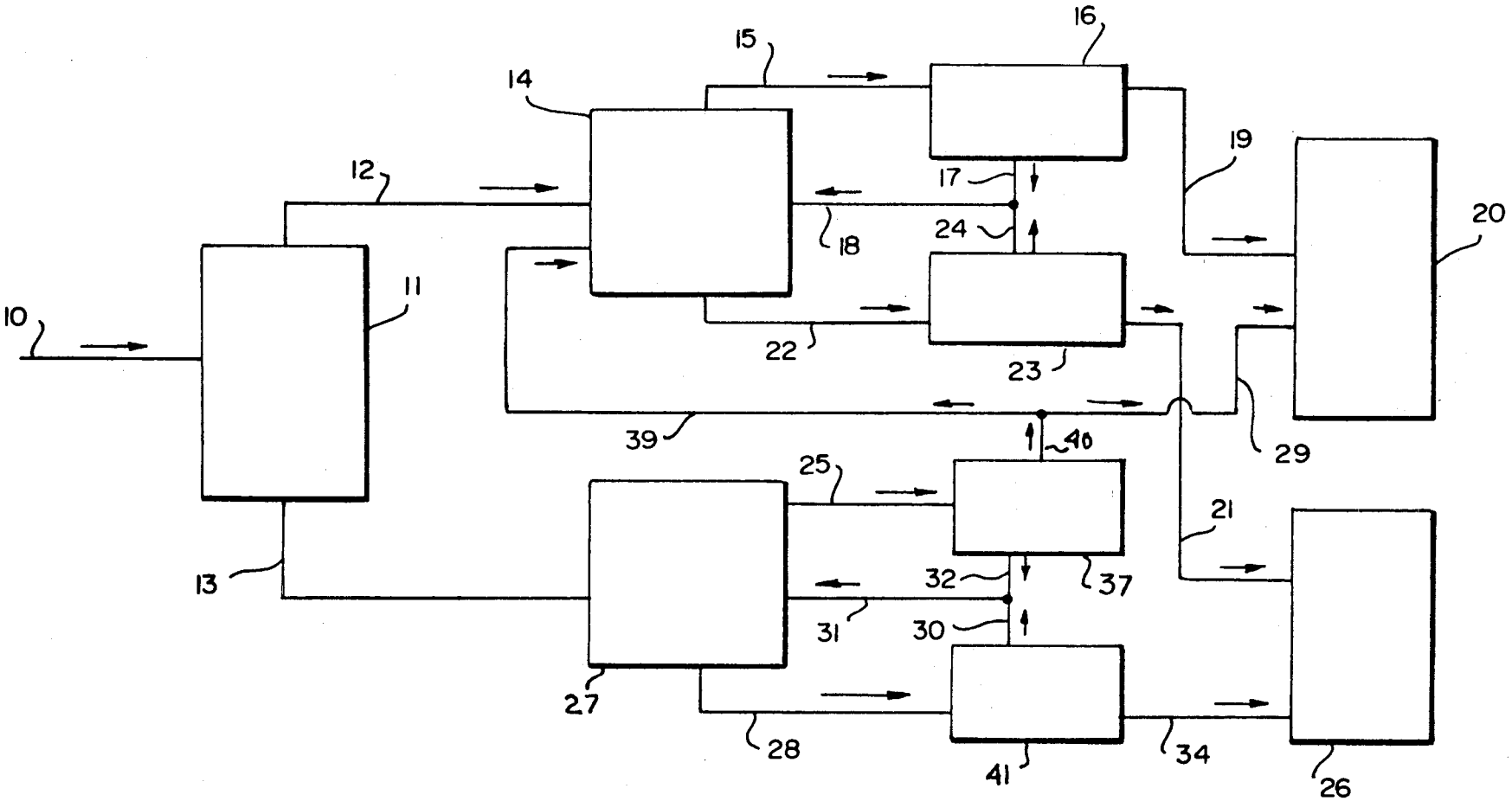
10
11
12
13
14
15
16
17
18
19
20
21
22
23
24
25
26
27
28
29
30
31
32
34
37
39
41
46

HIGH EFFICIENCY PROCESS FOR PREPARATION OF GASOLINE BY CATALYTIC CRACKING

This invention relates to petroleum processing. More particularly it relates to catalytic cracking.

BACKGROUND OF THE INVENTION

As is well known to those skilled in the art, processing of crude oil may include many steps in order to permit ultimate recovery of maximum quantity of products boiling in the gasoline and middle distillate boiling range. Typically crude oil is subjected to atmospheric distillation to yield overhead including light ends and fractions boiling in the gasoline boiling range, intermediate side cuts typified by gas oils, and as bottoms a topped or reduced crude. The latter is commonly subjected to further distillation in a vacuum tower from which are commonly recovered inter alia a vacuum gas oil fraction and as bottoms vacuum resid. The gas oil cuts are commonly passed to catalytic cracking wherein they are converted to fractions boiling in the gasoline and middle distillate boiling range.

The crudes which are used with increasing frequency are those with a higher content of undesirable components, particularly sulfur. It is not uncommon to charge crude containing as much as 2 wt % sulfur. This sulfur content is found in the products of atmospheric distillation including the topped crude. The vacuum gas oil, recovered from vacuum distillation, may be found to contain as much as 4 wt % sulfur. If this vacuum gas oil be passed directly to catalytic cracking, as has heretofore been done in the case of streams derived from low sulfur crudes, the sulfur undesirably shows up in the regenerator off-gas from the catalytic cracking unit. The presence of sulfur oxides in regenerator off-gas is undesirable because emission standards are becoming increasingly strict; and there is no way to economically remove sulfur oxides from the regenerator off-gas. Because of this, it has been increasingly common to attempt to remove sulfur from various streams that serve as feedstock for the catalytic cracking unit.

One approach to this problem is to subject the virgin gas oil to solvent extraction prior to admission to catalytic cracking This may be carried out for example in an MP refining operation in which the charge gas oil is contacted with N-methyl pyrrolidone. This treatment removes sulfur and nitrogen components from the gas oil; and it also removes aromatics. In typical operation, MP refining may reduce the sulfur content of a gas oil (with an initial sulfur content of 2 w %) down to as low as 0.7 w %. The nitrogen content may also be reduced from an initial level of 750 wppm down to a final level of 250. Simultaneously the aromatics content may be reduced from an initial level of 50 w % to a final value of 30 w %.

MP refining may yield a solvent refined oil of reduced volume. Typically such an oil may be only 70–80 v % of that originally charged to the MP unit; and the decrease will reflect the volume of aromatics which have been extracted from the oil. It is not uncommon to find that MP refining of a virgin gas oil may yield a solvent extracted gas oil which is as little as only 70 w % of the volume of virgin vacuum gas oil charged to solvent refining This means that the catalytic cracking operation to which the refined gas oil is passed will operate substantially below design capacity based on untreated vacuum gas oil.

It is an object of this invention to provide a process for operating a petroleum refinery at increased efficiency. Other objects will be apparent to those skilled in the art.

STATEMENT OF THE INVENTION

In accordance with certain of its aspects, this invention is directed to a method which comprises (i) vacuum distilling a topped crude thereby producing a virgin vacuum gas oil containing high levels of sulfur, nitrogen, and aromatics and a vacuum resid containing high levels of sulfur, nitrogen, carbonaceous materials, metals, and asphaltenes;

(ii) solvent refining said virgin vacuum gas oil containing aromatics thereby forming a raffinate containing a decreased quantity of aromatics;

(iii) passing said raffinate containing a decreased quantity of aromatics to catalytic cracking;

(iv) deasphalting said vacuum resid containing asphaltenes thereby forming a deasphalted vacuum resid containing a decreased quantity of asphaltenes; and (v) passing said deasphalted vacuum resid containing a decreased quantity of asphaltenes to said catalytic cracking.

DESCRIPTION OF THE INVENTION

The charge crudes which may be used in practice of the process of this invention may include any of a wide range of crudes typified by heavy crude, light crude, sweet crude, or sour crude. It is a particular feature of the process of this invention that maximum benefits may be attained when the charge crude is a sour crude typified by the following:

TABLE

| | |
|---|---|
| Gravity API | 33 |
| IBP °F. | 100 |
| Sulfur W % | 2.7 |
| Nitrogen W ppm | 750 |

In practice of the process of this invention, a crude such as the first above-listed may be subjected to atmospheric distillation to yield inter alia as bottoms a topped crude having typically the following properties:

TABLE

| | |
|---|---|
| Gravity API | 18.0 |
| IBP °F. | 650 |
| 50% BP °F. | 900 |
| Sulfur W % | 3.5 |
| Nitrogen W ppm | 1500 |

Typically a topped crude obtained as bottoms from atmospheric distillation of such a crude may be subjected to vacuum distillation at 10–50 mm. Hg, say about 20 mm. Hg to yield inter alia a virgin vacuum gas oil typically having the properties:

TABLE

| | |
|---|---|
| Gravity API | 25 |
| IBP °F. | 650 |
| 50% BP °F. | 760 |
| EP °F. | 1000 |
| Aromatics W % | 50 |

Vacuum distillation also yields inter alia as bottoms, a vacuum resid which is typically characterized by the following properties:

TABLE

| | |
|---|---|
| Gravity API | 8.5 |
| IBP °F. | 1000 |
| Aromatics W % | 50 |
| Sulfur W % | 4.2 |
| Nitrogen W % | 0.28 |
| Con Carbon W % | 14 |

In practice of the process of this invention, the virgin vacuum gas oil is subjected to solvent refining. This may be effected by use of solvents typified by phenol, furfural, N-methyl pyrrolidone (MP), etc. In the case of MP refining, the charge virgin vacuum gas oil (100 parts) may be contacted with 150–300 parts, say 200 parts of MP in a solvent extraction operation at 120° F.–200° F., say 150° F. to yield 10–40 parts, say 25 parts of extract and 60–90 parts, say 75 parts, of raffinate.

The extract stream may typically be characterized as follows:

TABLE

| | |
|---|---|
| Gravity API | 15 |
| Sulfur W % | 7.6 |
| Aromatics W % | 95 |
| Nitrogen w ppm | 2000 |

The raffinate stream may typically be characterized as follows:

TABLE

| | |
|---|---|
| Gravity API | 29 |
| Sulfur W % | 0.8 |
| Nitrogen w ppm | 200 |
| Aromatics W % | 30 |

The extract stream which contains a substantial portion of the nitrogenous and sulfur components of the vacuum gas oil charged to solvent extraction, as well as a substantial portion of the aromatic content of that charge stream, may be passed to a solvent recovery operation in which the solvent is stripped from the extract stream. The stripped solvent may be recycled to the solvent refining operation; and the stripped extract stream, which contains a substantial portion of the aromatics which were originally present in the vacuum gas oil, may be passed to fuel oil storage or further processing in the refinery.

The raffinate stream from solvent refining may be passed to a recovery section wherein solvent is stripped therefrom. The solvent is preferably recycled to the solvent extraction operation.

The solvent-free raffinate, typically in amount of 60–90 v % of the virgin gas oil from which it was prepared, is passed to catalytic cracking. It is a feature of the process of this invention that since this stream contains a substantially decreased content of aromatics, it is possible to conduct catalytic cracking with much greater efficiency than would be the case if the vacuum gas oil had not been dearomatized. Since typically this stream is 10–40 v % smaller than the corresponding quantity of non-dearomatized gas oil, this permits the refiner to charge other streams to the catalytic cracking operation and thus to utilize it at higher efficiency.

Catalytic cracking in the FCCU may typically be carried out under the following conditions:

TABLE

| | |
|---|---|
| Temperature °F. | 950–1000° F. |
| Pressure psig | 30 |

In practice of the process of this invention, the vacuum resid obtained from vacuum distillation may be subjected to solvent deasphalting in a solvent deasphalting unit—typically a propane deasphalting unit at the following conditions:

TABLE

| | |
|---|---|
| Temperature °F. | 160° F. |
| Pressure psig | 450 |

It is a feature of the process of this invention that the deasphalted oil recovered as extract from solvent deasphalting may (either without or preferably with removal of solvent therefrom) be passed to the cracking operation together with the raffinate (from which the solvent has been stripped) from the solvent extraction of the virgin gas oil.

It is a further feature of this invention that the deasphalted oil extract recovered from solvent deasphalting may, after removal of solvent therefrom, be treated in a solvent extraction unit in a manner similar to that used for or preferably combined with the virgin vacuum gas oil prior to solvent extraction. This mode of operation will further improve the qualities of the deasphalted oil for use as FCC Feedstock. Characterization of (i) the untreated vacuum resid, (ii) solvent deasphalted vacuum resid, and (iii) solvent deasphalted and solvent refined resid (if solvent refined separately from the virgin vacuum gas oil) may be typified by the following:

| | Virgin Vacuum Resid | Deasphalted Vacuum Resid | Deasphalted and Solvent Refined Vacuum Resid |
|---|---|---|---|
| Gravity, API | 8.5 | 21.0 | 25.0 |
| Sulfur, W % | 4.3 | 2.4 | 0.9 |
| Nitrogen, W % | 0.3 | 0.1 | 0.04 |
| ConCarbon, W % | 21.0 | 1.5 | 0.6 |
| Aromatics, W % | 50.0 | 15.0 | 11.0 |
| Nickel, W ppm | 21.0 | 0.3 | 0.1 |
| Vanadium, W ppm | 70.0 | 1.0 | 0.3 |

It is apparent from the above Table that the last column indicates there is substantial improvement in the vacuum resid stream which has been deasphalted and solvent refined—with respect to content of impurities such as sulfur.

In one preferred embodiment the deasphalted oil stream (preferably after solvent removal) may be mixed with the virgin vacuum gas oil prior to solvent extraction.

The raffinate from deasphalting which contains solvent and asphaltenes is preferably passed to a solvent stripping operation from which the solvent is recycled to the deasphalting operation and the solvent-free stream containing the asphaltenes may be passed to fuel oil inventory.

It will be apparent to those skilled in the art that the process of this invention is characterized by several advantages:

(i) it permits operation of a catalytic cracking unit under conditions which reduce the amount of sulfur oxides in the regenerator off-gas;

(ii) it permits operation of a catalytic cracking unit under conditions in which a smaller amount of carbon is deposited on the catalyst in the reactor because of the presence of smaller quantities of aromatics;

(iii) it permits operation, if desired, of the catalytic cracking unit at lower capacity with resulting savings in operating costs and a superior yield structure;

(iv) most importantly, it permits the refiner to feed other streams to the catalytic cracking unit and to thus desirably operate the cracking unit at design capacity which is the most efficient mode of operation; and (v) it gives the refiner added flexibility to pass other streams to catalytic cracking which if not treated by the process of the instant invention, would have to be treated in a less economic manner.

Practice of the process of this invention will be apparent to those skilled in the art from inspection of the following specific embodiment wherein, as elsewhere in this specification, all parts are parts by weight unless otherwise stated.

DESCRIPTION OF THE DRAWING

The drawing represents a schematic flow sheet according to which the process may be carried out according to one embodiment.

DESCRIPTION OF SPECIFIC EMBODIMENT

In accordance with the best mode presently known of carrying out the process of this invention, an Arabian crude oil (100 parts) is subjected to atmospheric distillation to yield 45 parts of topped crude having the following properties:

TABLE

| | | |
|---|---|---|
| Gravity | API | 18 |
| Sulfur | W % | 3.5 |
| Nitrogen | W ppm | 1500 |
| Carbon Residue | W % | 9 |
| IBP °F. | 650 | |

This topped crude (45 parts) is passed through line 10 of the attached drawing (which represents a schematic process flow sheet of a processing scheme by which the process of this invention may be carried out) to vacuum distillation tower 11. Feed temperature may be 750° F. at 50 mm Hg. There are recovered from this vacuum distillation operation (i) a virgin vacuum gas oil withdrawn through line 12 and (ii) a vacuum resid which is withdrawn through line 13. The virgin vacuum gas oil, withdrawn at 700° F., (23 parts) may be characterized by the following properties :

TABLE

| | | |
|---|---|---|
| Gravity | °API | 25 |
| Sulfur | W % | 2.7 |
| Nitrogen | W ppm | 750 |
| Aromatics | W % | 50 |

The virgin vacuum gas oil (23 parts) is passed through line 12 to solvent extraction operation 14 wherein it is contacted with 50 parts of N-methyl pyrrolidone. MP refining in operation 14 is carried out at the following conditions:

TABLE

| | |
|---|---|
| Temperature °F. | 150 |
| Pressure psig | 25 |

The raffinate stream from solvent refining, withdrawn through line 15 in amount of 17 parts is characterized as follows:

TABLE

| | | |
|---|---|---|
| API | Gravity | 29 |
| W % | Sulfur | 0.8 |
| W ppm | Nitrogen | 190 |
| W % | Aromatics | 30 |
| 50% | BP °F. | 800 |

The raffinate stream, in this preferred embodiment is passed through line 15 to solvent recovery operation 16 wherein solvent (10 parts) may be stripped from the raffinate and recycled to solvent refining operation 14 through lines 17 and 18.

Solvent-free raffinate (17 parts) is withdrawn through line 19 and passed to catalytic cracking operation 20.

The extract from solvent refining operation 14 may be withdrawn therefrom through line 22 and passed to solvent recovery operation 23 wherein solvent (60 parts) is recovered and preferably recycled to solvent extraction through line 24 and line 18. Solvent-free extract (6 parts) in line 21 may be characterized as follows:

TABLE

| | | |
|---|---|---|
| Gravity | API | 15.0 |
| Sulfur | W % | 7.6 |
| Aromatics | W % | 95 |

Solvent-free extract may be passed through line 21 to inventory 26.

The vacuum resid (22 parts) recovered in line 13 from the bottom of the vacuum distillation operation 11, is passed to deasphalting unit 27 wherein it is contacted with propane (40 parts). Deasphalting is carried out at the following conditions:

TABLE

| | |
|---|---|
| Temperature °F. | 160 |
| Pressure, psig | 450 |

Extract, also referred to as deasphalted oil, (14 parts) may be recovered from solvent deasphalting through line 25 and is characterized as follows:

TABLE

| | |
|---|---|
| Gravity AP | 20 |
| Sulfur W % | 2.4 |
| Nitrogen W ppm | 1000 ppm |
| Carbon Residue W % | 1.5 |

Raffinate (also referred to as asphalt) (8 parts) is passed through line 28 to solvent recovery operation wherein propane (40 parts) is stripped therefrom and returned through lines 30 and 31, to solvent deasphalting operation 27.

Asphalt from solvent recovery operation 41 is passed through line 34 to inventory 26.

It is a feature of this invention that the extract (also referred to as deasphalted oil) recovered in line 40 from solvent recovery operation 37 may be characterized as follows:

TABLE

| | | |
|---|---|---|
| Gravity | API | 20 |
| Sulfur | W % | 2.4 |
| Con carbon | W % | 1.5 |

TABLE-continued

| | | |
|---|---|---|
| Nitrogen | w ppm | 1000 |

The deasphalted oil plus solvent in line 25 (say (54 parts) is passed to solvent recovery operation 37. Here solvent (40 parts) may be recovered and passed to deasphalting operation 27 through lines 32 and 31. Deasphalted oil recovered in solvent recovery operation 37 (14 parts) may be passed to solvent extraction operation 14 through lines 40 and 39.

The extract in line 40 (14 parts) may alternatively be passed in whole or in part directly to catalytic cracking through line 29. Catalytic cracking operation 20 may be operated at the following conditions:

TABLE

| | |
|---|---|
| Temperature °F. | 950-1000 |
| Pressure psig | 30 |

To improve the quality of the FCC feedstock, a portion or all, of the deasphalted oil in line 40 can be passed to the solvent refining unit 14, where it can be mixed with the virgin gasoil charge to the solvent extraction unit. This alternative can make substantial improvements in the deasphalted oil to be used as FCC feedstock and it does reduce the volume of material. Whether or not this step is carried out, either partially or totally, will be governed by the specifics of the particular Fluid Catalytic Cracking Unit being fed by the treated deasphalted oil. On one hand, if the Fluid Catalytic Unit is at, or close to, its statutory limit of sulfur emissions, treating most or all of the deasphalted oil in operation 14 might be necessary. On the other hand, if there is some margin to increase sulfur emissions (and there are no other processing benefits that might be obtained by solvent refining the deasphalted oil) some or all of the deasphalted oil in line 40 might be passed directly to the Fluid Catalytic Unit through line 29, bypassing the solvent Extraction Process. Each processor will weigh such factors as statutory emission limits, volumetric feed limitations on the FCCU, type of crude feedstock, operating conditions, operating limitations and yield economic factors to determine what proportion of the deasphalted oil to solvent refine and what proportion to route directly to the Fluid Catalytic Cracking Unit.

It will be apparent to those skilled in the art that this process can permit operation of the catalytic cracking unit at full capacity. If the charge to cracking contained only the MP refined virgin vacuum gas oil in line 19 (17 parts), the cracking unit would be operated at only about 70% of its design capacity. It is possible by the process of this invention to pass to cracking 6 parts of deasphalted vacuum resid from line 40 through line 29 and to thus permit the cracking operation to operate at 100% of capacity. Alternatively it is possible to pass the stream in line 40, in whole or in part, through line 39 to be solvent extracted in 14 with the vacuum gas oil from line 12.

A major advantage in feed quality is realized by this process. A comparison of the untreated virgin vacuum gas oil and the combined (formed by passing streams from lines 12 and 39 to extraction operation 14) treated streams is as follows:

| | | Untreated | Treated VGO and Vacuum Resid |
|---|---|---|---|
| Gravity | API | 25 | 28.0 |
| Sulfur | wwpm | 2.7 | 0.9 |
| Nitrogen | W % | 750 | 400 |
| Aromatics | W % | 50 | 30 |
| ConCarbon | W % | 0.5 | 0.3 |

Although the process of this invention has been described with respect to specific embodiments it will be apparent to those skilled in the art that various changes may be made thereto which fall within the scope of the invention.

I claim:

1. The method which comprises (i) vacuum distilling a topped crude thereby, producing a virgin vacuum gas oil containing high levels of sulfur, nitrogen, and aromatics and a vacuum resid containing high levels of sulfur, nitrogen, carbonaceous materials, metals and asphaltenes;

(ii) solvent refining said virgin vacuum gas oil containing aromatics thereby forming a raffinate containing a decreased quantity of aromatics;

(iii) passing said raffinate containing a decreased quantity of aromatics to catalytic cracking;

(iv) deasphalting said vacuum resid containing asphaltenes thereby forming a deasphalted vacuum resid containing a decreased quantity of sulfur, nitrogen, carbonaceous materials, and asphaltenes; and (v) passing said deasphalted vacuum resid containing a decreased quantity of sulfur, nitrogen, carbonaceous materials, and asphaltenes to said catalytic cracking.

2. The method of claim 1 wherein said raffinate containing a decreased quantity of aromatic is passed to a stripping operation wherein solvent is stripped from said solvent refined virgin vacuum gas oil prior to catalytic cracking.

3. The method of claim 1 wherein at least a portion of said resid containing a decreased quantity of sulfur, nitrogen, carbonaceous materials, metals, and asphaltenes is passed directly to catalytic cracking without stripping.

4. The method of claim 1 wherein a portion of said resid containing a decreased quantity of sulfur, nitrogen, carbonaceous materials, metals, and asphaltenes is passed to a solvent recovery operation and at least a portion of the solvent recovered therein is recycled to said deasphalting operation.

5. The method of claim 4 wherein at least a portion of said resid containing a decreased quantity of sulfur, nitrogen, carbonaceous materials, metals, and asphaltenes is, after said solvent recovery operation, recycled to said solvent refining of said virgin gas oil.

6. The method of claim 1 wherein said virgin vacuum gas oil contains 2.5-3.0 w % sulfur .

7. The method of claim 1 wherein said virgin vacuum gas oil contains 40-50 w % aromatics.

8. The method of claim 1 wherein said solvent refined virgin vacuum gas oil contains 25-30 w % aromatics.

9. The method which comprises (i) vacuum distilling a topped crude thereby producing a virgin vacuum gas oil containing aromatics and a vacuum resid containing asphaltenes;

(ii) solvent refining said virgin vacuum gas oil containing aromatics thereby forming a raffinate containing solvent plus a decreased quantity of aromatics;

(iii) stripping said solvent from said raffinate containing solvent plus a decreased quantity of aromatics thereby forming a raffinate containing a decreased quantity of aromatics;

(iv) passing said raffinate containing a decreased quantity of aromatics to catalytic cracking;

(v) deasphalting said vacuum resid containing asphaltenes thereby forming a deasphalted vacuum resid containing a decreased quantity of asphaltenes; and (vi) passing said deasphalted vacuum resid containing a decreased quantity of asphaltenes to said solvent refining.

* * * * *